US009953597B2

(12) United States Patent
Yeo et al.

(10) Patent No.: US 9,953,597 B2
(45) Date of Patent: Apr. 24, 2018

(54) METHOD FOR DRIVING DISPLAY PANEL BY OUTPUTTING DATA SIGNALS ACCORDING TO DELAY SIGNAL, DRIVING UNIT OF DISPLAY PANEL AND DISPLAY DEVICE HAVING THE SAME

(71) Applicant: Samsung Display Co., Ltd., Yongin (KR)

(72) Inventors: Dong-Hyun Yeo, Yongin-si (KR); Eun-Seon Kim, Seoul (KR); Yong-Bum Kim, Suwon-si (KR); Suk-Jin Park, Daejeon (KR); Byung-Kil Jeon, Hwaseong-si (KR); Su-Hyun Jeong, Gwangju-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 484 days.

(21) Appl. No.: 14/688,968

(22) Filed: Apr. 16, 2015

(65) Prior Publication Data

US 2016/0133215 A1 May 12, 2016

(30) Foreign Application Priority Data

Nov. 10, 2014 (KR) ..... 10-2014-0155636

(51) Int. Cl.
*G09G 3/36* (2006.01)
*G09G 3/00* (2006.01)

(52) U.S. Cl.
CPC ..... *G09G 3/3648* (2013.01); *G09G 3/006* (2013.01); *G09G 2320/0223* (2013.01)

(58) Field of Classification Search
None
See application file for complete search history.

(56) References Cited

U.S. PATENT DOCUMENTS 6,288,699 B1 * 9/2001 Kubota ..... G09G 3/3648 345/213
6,407,729 B1 * 6/2002 Moon ..... G09G 3/3648 345/205

(Continued)

FOREIGN PATENT DOCUMENTS

KR 10-2008-0002564 1/2008
KR 10-2008-0035369 4/2008

(Continued)

*Primary Examiner* — Kent Chang
*Assistant Examiner* — Benjamin Morales Fernande
(74) *Attorney, Agent, or Firm* — H.C. Park & Associates, PLC

(57) ABSTRACT

A driving unit of display panel includes a data driving part, a timing controlling part and a gate driving part. The data driving part is configured to receive reference image data and includes a first data driving circuit part having a first channel outputting a first reference data signal based on the reference image data and a k-th channel outputting a k-th reference data signal based on the reference image data. The timing controlling part is configured to detect a time difference between the first reference data signal and the k-th reference data signal. The gate driving part is configured to output a gate signal to each of gate lines. By delaying data signals based on the gate signal delay caused by long line load and RC delay, the present invention may improve display quality of a display device.

20 Claims, 9 Drawing Sheets

(56) References Cited

U.S. PATENT DOCUMENTS

| | | | | |
|---|---|---|---|---|
| 9,626,925 | B2 * | 4/2017 | Cheng | G09G 3/3648 |
| 2004/0189579 | A1 * | 9/2004 | Shimizu | G09G 3/3688<br>345/98 |
| 2006/0114209 | A1 * | 6/2006 | Kim | G09G 3/3611<br>345/94 |
| 2007/0139339 | A1 * | 6/2007 | Kim | G09G 3/3648<br>345/98 |
| 2009/0015519 | A1 * | 1/2009 | Hori | G09G 3/20<br>345/60 |
| 2010/0271887 | A1 * | 10/2010 | Kwak | G11C 7/1051<br>365/194 |
| 2013/0321253 | A1 * | 12/2013 | Park | G09G 3/3611<br>345/100 |
| 2015/0179125 | A1 * | 6/2015 | Choi | G09G 3/20<br>345/212 |

FOREIGN PATENT DOCUMENTS

| | | |
|---|---|---|
| KR | 10-2013-0034539 | 4/2013 |
| KR | 10-2014-0050151 | 4/2014 |

* cited by examiner

METHOD FOR DRIVING DISPLAY PANEL BY OUTPUTTING DATA SIGNALS ACCORDING TO DELAY SIGNAL, DRIVING UNIT OF DISPLAY PANEL AND DISPLAY DEVICE HAVING THE SAME

CROSS-REFERENCE TO RELATED APPLICATION

This application claims priority from and the benefit of Korean Patent Application No. 10-2014-0155636, filed on Nov. 10, 2014, which is hereby incorporated by reference for all purposes as if fully set forth herein.

BACKGROUND

Field

Exemplary embodiments relate to a driving method of a display panel, a driving unit of display panel for performing the driving method and a display device having the driving unit of display panel.

Discussion of the Background

A display device such as a liquid crystal display device includes a display panel and a driving unit of display panel.

The display panel includes a plurality of gate lines extending in a first direction, a plurality of data lines extending in a second direction substantially perpendicular to the first direction, and a plurality of pixels defined by the gate lines and the data lines.

The driving unit of display panel includes a gate driving part outputting a gate signal to each of the gate lines and a data driving part outputting a data signal to each of the data lines.

Increased load and RC delay of the gate lines in the first direction delay an activation of the gate signal applied to the gate line depending on a distance to the first direction. This decreases a data charge rate, and thus degrading display quality of the device.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments of the present inventive concept provide a driving method of a display panel capable of improving display quality of a display device.

Exemplary embodiments of the present inventive concept also provide a driving unit of display panel for performing the above-mentioned method.

Exemplary embodiments of the present inventive concept also provide a display device having the above-mentioned driving unit of display panel.

Additional aspects will be set forth in the detailed description which follows, and, in part, will be apparent from the disclosure, or may be learned by practice of the inventive concept.

According to exemplary embodiments, a driving method of a display panel includes applying reference image data to a data driving part driving a display panel including a plurality of gate lines and a plurality of data lines, detecting a time difference between a first reference data signal output based on the reference image data and output through a first channel of a first data driving circuit part in the data driving part and a k-th reference data signal output based on the reference image data and output through a k-th channel of the first data driving circuit part, outputting a gate signal to each of the gate lines, and outputting a data signal based on image data to each of the data lines according to a delay signal including information on the time difference.

In one embodiment, the detecting the time difference between the first reference data signal and the k-th reference data signal may include receiving the first reference data signal, decreasing a voltage level of the first reference data signal to output a first decreased reference data signal, receiving the first decreased reference data signal, receiving the k-th reference data signal, decreasing a voltage level of the k-th reference data signal to output a k-th decreased reference data signal, receiving the k-th decreased reference data signal, and comparing the first decreased reference data signal with the k-th decreased reference data signal to detect the time difference between the first reference data signal and the k-th reference data signal.

In another embodiment, the detecting the time difference between the first reference data signal and the k-th reference data signal may include receiving the first reference data signal, receiving the k-th reference data signal, and comparing the first reference data signal with the k-th reference data signal to detect the time difference between the first reference data signal and the k-th reference data signal.

In one embodiment, outputting a data signal may include outputting a first data signal through the first channel of the first data driving circuit part, outputting a k-th data signal through the k-th channel of the first data driving circuit part by delaying the data signal according to the time difference, and outputting a first data signal through a first channel of a second data driving circuit part next to the first data driving circuit part by delaying the data signal according to at least more than the time difference.

In one embodiment, outputting the k-th data signal through the k-th channel of the first data driving circuit part may include applying the delay signal to the data driving part and setting an output time of the k-th data signal.

In one embodiment, outputting the first data signal through the first channel of the second data driving circuit part may include applying the delay time to the data driving part and setting an output time of the first data signal from the second data driving circuit part.

In one embodiment, the method may further include outputting a gate masking signal while the reference image data is applied to the data driving part and while detecting the time difference between the first reference data signal and the k-th reference data signal.

In one embodiment, the reference image data may apply to the data driving part during a vertical blank period.

In one embodiment, the time difference between the first reference data signal and the k-th reference data signal may be detected during the vertical blank period.

In one embodiment, the k-th channel of the first data driving circuit part may be a last channel of the first data driving circuit part.

According to exemplary embodiments, a driving unit of display panel includes a data driving part, a timing controlling part and a gate driving part. The data driving part is configured to receive reference image data and output a data signal based on image data to a data line of a display panel including a gate line and the data line. The data driving part includes a first data driving circuit part having a first channel outputting a first reference data signal based on the reference image data and a k-th channel outputting a k-th reference data signal based on the reference image data. The timing controlling part is configured to output the reference image data to the data driving part and detect a time difference between the first reference data signal and the k-th reference data signal. The first reference data signal is output through the first channel of the first data driving circuit part in the data driving part, and the k-th reference data signal is output through the k-th channel of the first data driving circuit part in the data driving part. The gate driving part is configured to output a gate signal to each of the gate lines.

In one embodiment, the data driving part may output the data signal based on the image data to each of the data lines according to a delay signal including information on the time difference.

In one embodiment, the display panel driving apparatus may include a voltage level decreasing part configured to decrease a voltage level of the first reference data signal and decrease a voltage level of the k-th reference data signal. The voltage level decreasing part may include a first level shifter and a second level shifter. The first level shifter is configured to receive the first reference data signal from the data driving part, decrease the first reference data signal, and output a first decreased reference data signal to the timing controlling part. The second level shifter is configured to receive the k-th reference data signal from the data driving part, decrease the k-th reference data signal, and output a k-th decreased reference data signal to the timing controlling part.

According to exemplary embodiments, a display device includes a display panel and a driving unit of display panel. The display panel includes a plurality of gate line and a plurality of data line. The driving unit of display panel includes a data driving part, a timing controlling part and a gate driving part. The data driving part is configured to receive reference image data and output a data signal based on image data to the data line. The data driving part includes a first data driving circuit part having a first channel outputting a first reference data signal based on the reference image data and a k-th channel outputting a k-th reference data signal based on the reference image data. The timing controlling part is configured to output the reference image data to the data driving part and detect a time difference between the first reference data signal output through the first channel of the first data driving circuit part in the data driving part and the k-th reference data signal output through the k-th channel of the first data driving circuit part in the data driving part. The gate driving part is configured to output a gate signal to the gate line.

In one embodiment, the gate driving part may include a first gate driving part configured to output the gate signals to a first end of the gate lines, and a second gate driving part configured to output the gate signals to a second end of the gate lines.

According to the present inventive concept, a data charge rate may be increased by preventing a decrease of a data charge rate owing to a load of a gate line and an RC delay of the gate line GL. Thus, display quality of a display device may be improved.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

DETAILED DESCRIPTION OF THE ILLUSTRATED EMBODIMENTS

Figure 1:
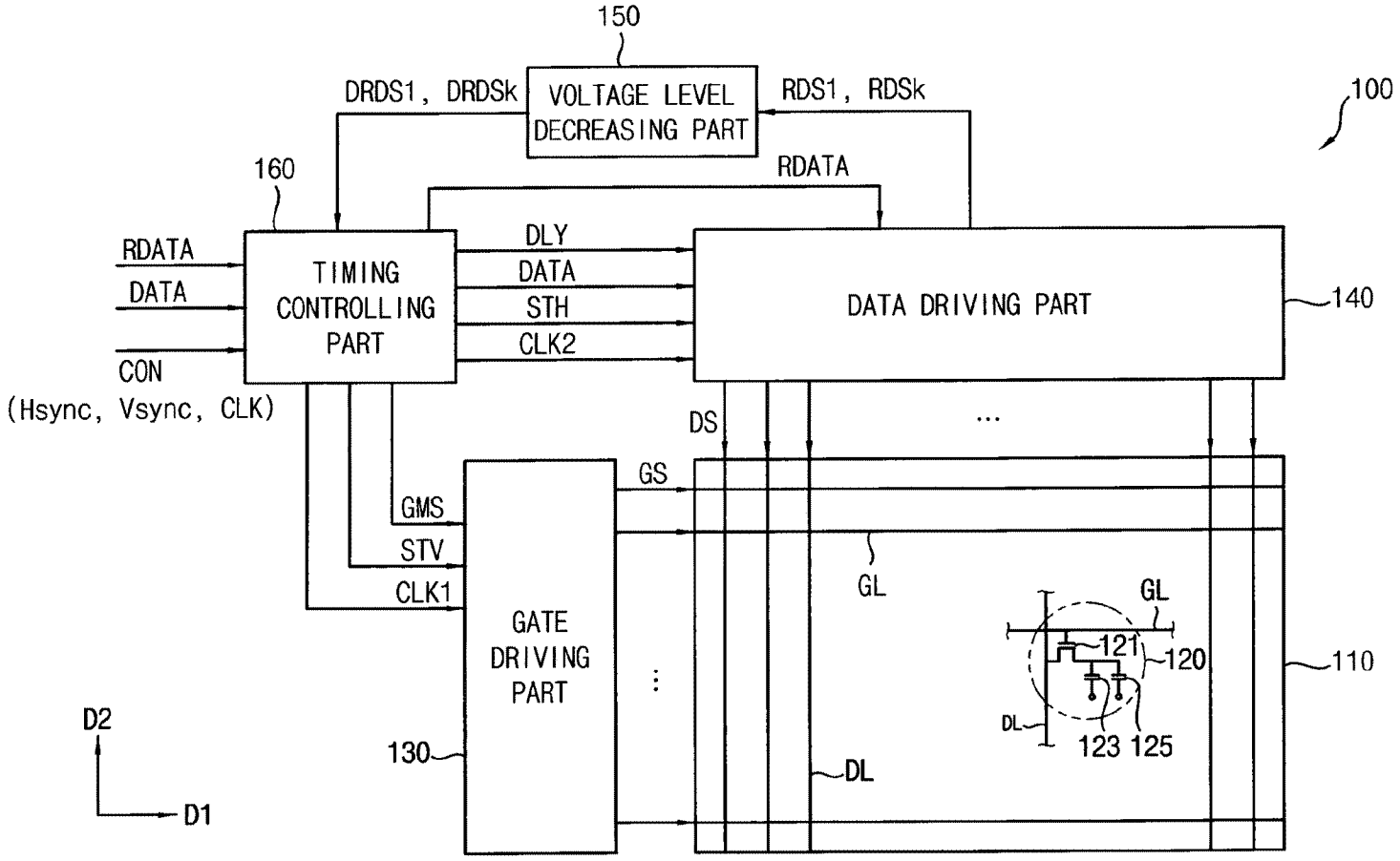
FIG. 1 is a block diagram illustrating a display device according to an exemplary embodiment of the present inventive concept.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

FIG. 1 is a block diagram illustrating a display device according to an exemplary embodiment of the present inventive concept.

Referring to FIG. 1, the display device 100 according to the present exemplary embodiment includes a display panel 110, a gate driving part 130, a data driving part 140, a voltage level decreasing part 150 and a timing controlling part 160.

The display panel 110 receives data signals DS based on image data DATA provided from the timing controlling part 160 to display an image. For example, the image data DATA may be two-dimensional plane image data. Alternatively, the image data DATA may include left-eye image data and right-eye image data for displaying a three-dimensional stereoscopic image.

The display panel 110 includes a plurality of gate lines GL, a plurality of data lines DL and a plurality of pixels 120. The gate lines GL extend in a first direction D1 and are arranged in a second direction D2 substantially perpendicular to the first direction D1. The data lines DL extend in the second direction D2 and are arranged in the first direction D1. Each of the pixels 120 includes a thin film transistor 121 electrically connected to each of the gate lines GL and the data lines DL corresponding thereto, a liquid crystal capacitor 123 and a storage capacitor 125 connected to the thin film transistor 121.

The gate driving part 130, the data driving part 140, the voltage level decreasing part 150 and the timing controlling part 160 may be defined as a driving unit of display panel driving the display panel 110.

The gate driving part 130 generates gate signals GS in response to a gate start signal STV and a gate clock signal CLK1 provided from the timing controlling part 160, and outputs the gate signal GS to each of the gate lines GL. In addition, the gate driving part 130 may not output the gate signal GS or may deactivate the gate signal GS according to a gate masking signal provided from the timing controlling part 160. A period when the gate signal GS may not be output or the gate signal GS may be deactivated may be a vertical blank period.

The data driving part 140 outputs data signal DS to the data lines DL in response to a data start signal STH and a data clock signal CLK2 provided from the timing controlling part 160. Here, the data driving part 140 outputs the data signal DS to each of the data lines DL according to a delay signal DLY provided from the timing controlling part 160.

In addition, the data driving part 140 receives reference image data RDATA provided from the timing controlling part 160, and outputs a first reference data signal RDS1 and a k-th reference data signal RDSk based on the reference image data RDATA to the voltage level decreasing part 150. Here, the first reference data signal RDS1 may be a signal output through a first channel of at least one data driving circuit part in the data driving part 140. The k-th reference data signal RDSk may be a signal output through a k-th channel of at least one data driving circuit part in the data driving part 140. The k-th channel of the data driving circuit part may be a last channel of the data driving circuit part.

The voltage level decreasing part 150 receives the first reference data signal RDS1 output from the data driving part 140, decreases a voltage level of the first reference data signal RDS1, and outputs a first decreased reference data signal DRDS1 to the timing controlling part 160. The first decreased reference data signal DRDS1 may have a voltage level proper to be applied to the timing controlling part 160. In addition, the voltage level decreasing part 150 receives the k-th reference data signal RDSk output from the data driving part 140, decreases a voltage level of the k-th reference data signal RDSk, and outputs a k-th decreased reference data signal DRDSk to the timing controlling part 160. The k-th decreased reference data signal DRDSk may have a voltage level proper to be applied to the timing controlling part 160.

Alternatively, when the first reference data signal RDS1 output from the data driving part 140 has a voltage level proper to be applied to the timing controlling part 160 and the k-th reference data signal RDSk output from the data driving part 140 has a voltage level proper to be applied to the timing controlling part 160, the voltage level decreasing part 150 may be omitted. In this case, the first reference data signal RDS1 output from the data driving part 140 and the k-th reference data signal RDSk output from the data driving part 140 may be directly applied to the timing controlling part 160.

The timing controlling part 160 receives the image data DATA and a control signal CON from an outside. The control signal CON may include a horizontal synchronous signal Hsync, a vertical synchronous signal Vsync and a clock signal CLK. The timing controlling part 160 generates the data start signal STH using the horizontal synchronous signal Hsync and outputs the data start signal STH to the data driving part 140. In addition, the timing controlling part 160 generates the gate start signal STV using the vertical synchronous signal Vsync and outputs the gate start signal STV to the gate driving part 130. In addition, the timing controlling part 160 generates the gate clock signal CLK1 and the data clock signal CLK2 using the clock signal CLK, outputs the gate clock signal CLK1 to the gate driving part 130, and outputs the data clock signal CLK2 to the data driving part 140. In addition, the timing controlling part 160 outputs the gate masking signal GMS which prevents an output of the gate signal GS or deactivates the gate signal GS during the vertical blank period to the gate driving part 130.

In addition, the timing controlling part 160 receives the reference image data RDATA from outside and outputs the reference image data RDATA to the data driving part 140 during the vertical blank period. For example, the reference image data RDATA may be the data displaying stripe patterns, a polarity of the reference image data RDATA may be inverted in every pixel 120 in the first direction D1 and the second direction D2, may be inverted in every two pixels 120 in the first direction D1 and the second direction D2, and may be inverted in every four pixels 120 in the first direction D1 and the second direction D2.

In addition, the timing controlling part 160 receives the first decreased reference data signal DRDS1 and the k-th decreased reference data signal DRDSk from the voltage level decreasing part 150, calculates a time difference between an output of the first decreased reference data signal DRDS1 and an output of the k-th decreased reference data signal DRDSk, and detects a time difference between an output of the first reference data signal RDS1 and an output of the k-th reference data signal RDSk. The timing controlling part 160 outputs the delay signal DLY including information on the time difference between the output time of the first reference data signal RDS1 and the output time of the k-th reference data signal RDSk to the data driving part 140. The timing controlling part 160 may detect the time difference and output the delay signal DLY during the vertical blank period. The delay signal DLY may be applied to the data driving part 140 through an interface protocol, and the delay signal DLY may be allocated to a portion for setting frame construction and configuration in the interface protocol.

Figure 2:
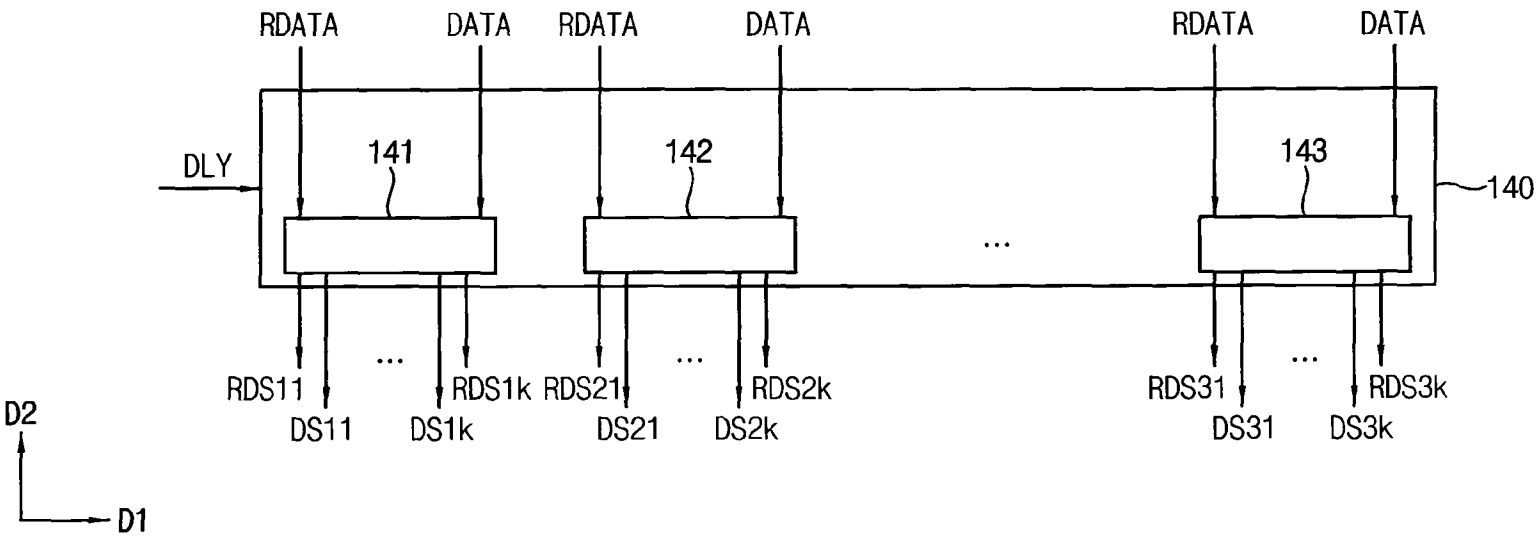
FIG. 2 is a block diagram illustrating a data driving part of FIG. 1.

FIG. 2 is a block diagram illustrating the data driving part 140 of FIG. 1.

Referring to FIGS. 1 and 2, the data driving part 140 may include a plurality of data driving circuit parts 141, 142 and 143. The data driving circuit parts 141, 142 and 143 may be sequentially disposed in the first direction D1. Thus, a first data driving circuit part 141 among the data driving circuit parts 141, 142 and 143 may be disposed at a first position in the first direction D1, a second data driving circuit part 142 may be disposed next to the first data driving circuit part 141 in the first direction D1, and a third data driving circuit part 143 may be disposed at a last position in the first direction D1.

The first data driving circuit part 141 receives the reference image data RDATA, outputs a first reference data signal RDS11 through a first channel of the first data driving circuit part 141 and outputs a k-th reference data signal RDS1*k* through a k-th channel of the first data driving circuit part 141. Equally, the second data driving circuit part 142 receives the reference image data RDATA, outputs a first reference data signal RDS21 through a first channel of the second data driving circuit part 142 and outputs a k-th reference data signal RDS2*k* through a k-th channel of the second data driving circuit part 142, and the third data driving circuit part 143 receives the reference image data RDATA, outputs a first reference data signal RDS31 through a first channel of the third data driving circuit part 143 and outputs a k-th reference data signal RDS3*k* through a k-th channel of the third data driving circuit part 143.

In addition, the first data driving circuit part 141 receives the image data DATA and outputs first to k-th data signals DS11, . . . , and DS1*k* through a plurality of channels. In this case, the first data driving circuit part 141 outputs the first to k-th data signals DS11, . . . , and DS1*k* according to the delay signal DLY. The delay signal DLY includes information on a time difference between an output time of the first reference data signal RDS11 which is output through the first channel of the first data driving circuit part 141 and an output time of the k-th reference data signal RDS1*k* which is output through the k-th channel of the first data driving circuit part 141. The first data driving circuit part 141 delays the output of the k-th data signal DS1*k* compared to the output of the first data signal DS11 according to the time difference based on the delay signal DLY. Thus, the delay signal DLY may set an output time of the k-th data signal DS1*k* of the first data driving circuit part 141.

In addition, the second data driving circuit part 142 receives the image data DATA and outputs first to k-th data signals DS21, . . . , and DS2*k* through a plurality of channels like the first driving circuit 141. In this case, the second data driving circuit part 142 outputs the first to k-th data signals DS21, . . . , and DS2*k* according to the delay signal DLY. The delay signal DLY includes information on a time difference between an output time of the first reference data signal RDS21 which is output through the first channel of the second data driving circuit part 142 and an output time of the k-th reference data signal RDS2*k* which is output through the k-th channel of the second data driving circuit part 142. The second data driving circuit part 142 delays the output of the k-th data signal DS2*k* compared to the output of the first data signal DS21 according to the time difference based on the delay signal DLY.

In addition, the second data driving circuit part 142 outputs the first data signal DS21 according to the delay signal DLY. Specifically, the second data driving circuit part 142 delays the first data signal DS21 output through the first channel of the second data driving circuit part 142 compared to the output of the first data signal DS11 output through the first channel of the first data driving circuit part 141 disposed closer to the gate driving part 130 than the second data driving circuit part 142 according to the time difference or more, which is between the output time of the first reference data signal RDS11 output from the first data driving circuit part 141 and the output time of the k-th reference data signal RDS1*k* output from the first data driving circuit part 141. Thus, the delay signal DLY may set an output time of the first data signal DS21 of the second data driving circuit part 142.

In the same manner, the third data driving circuit part 143 receives the image data DATA and outputs first to k-th data signals DS31, . . . , and DS3*k* through a plurality of channels.

The first reference data signal RDS11 output through the first channel of the first data driving circuit part 141, the first reference data signal RDS21 output through the first channel of the second data driving circuit part 142, and the first reference data signal RDS31 output through the first channel of the third data driving circuit part 143 illustrated in FIG. 2 may be included in the first reference data signal RDS1 illustrated in FIG. 1. In addition, the k-th reference data signal RDS1*k* output through the k-th channel of the first data driving circuit part 141, the k-th reference data signal RDS2*k* output through the k-th channel of the second data driving circuit part 142, and the k-th reference data signal RDS3*k* output through the k-th channel of the third data driving circuit part 143 illustrated in FIG. 2 may be included in the k-th reference data signal RDSk illustrated in FIG. 1.

In addition, the first to k-th data signals DS11, . . . , and DS1*k* output through the plurality of channels of the first data driving circuit part 141, the first to k-th data signals DS21, . . . , and DS2*k* output through the plurality of channels of the second data driving circuit part 142, and the first to k-th data signals DS31, . . . , and DS3*k* output through the plurality of channels of the third data driving circuit part 143 illustrated in FIG. 2 may be included in the data signals DS illustrated in FIG. 1.

Figure 3:
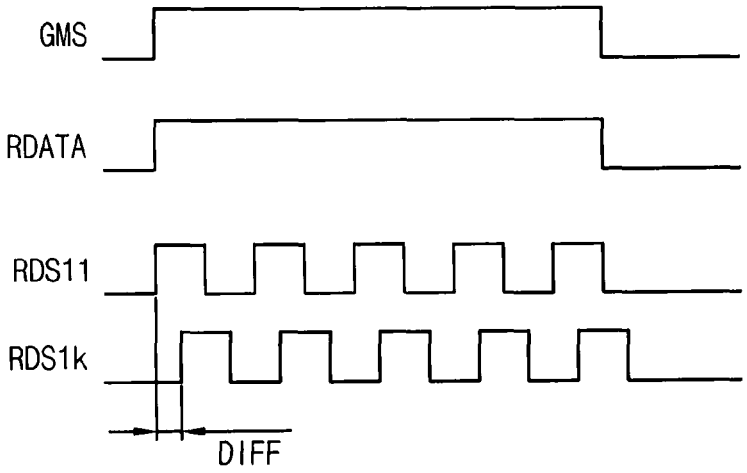
FIG. 3 is a waveforms diagram illustrating a gate masking signal, reference image data, a first reference data signal and a k-th reference data signal of FIG. 1 and FIG. 2.

FIG. 3 is a waveforms diagram illustrating the gate masking signal GMS, the reference image data RDATA, the first reference data signal RDS11 and the k-th reference data signal RDS1*k* of FIGS. 1 and 2.

Referring to FIGS. 1 to 3, a time difference DIFF is generated between the first reference data signal RDS11 output through the first channel of the first data driving circuit part 141 and the k-th reference data signal RDS1*k* output through the k-th channel of the first data driving circuit part 141. Specifically, a load of the gate line GL and an RC delay of the gate line GL are increasing in the first direction D1. Therefore, the k-th reference data signal RDS1*k* is delayed and activated according to the time difference DIFF compared to the first reference data signal RDS11.

Since the load of the gate line GL and the RC delay of the gate line GL are increased in the first direction D1 and the first data driving circuit part 141 disposed closer to the gate driving part 130 than the second data driving circuit part 142, a time difference between the output time of the first reference data signal RDS21 output from the second data driving circuit part 142 and an output time of the k-th reference data signal RDS2*k* output from the second data driving circuit part 142 may be longer than that of the time difference between the output time of the first reference data signal RDS11 output through the first data driving circuit part 141 and the output time of the k-th reference data signal RDS1*k* output from the first data driving circuit part 141. Thus, the farther a data driving circuit part in the data driving part 140 is from the gate driving part 130 in the first direction D1, the longer a time difference between an output time of a first reference data signal output through a first channel of the data driving circuit part and an output time of a k-th reference data signal output through a k-th channel of the data driving circuit part may be.

Figure 4:
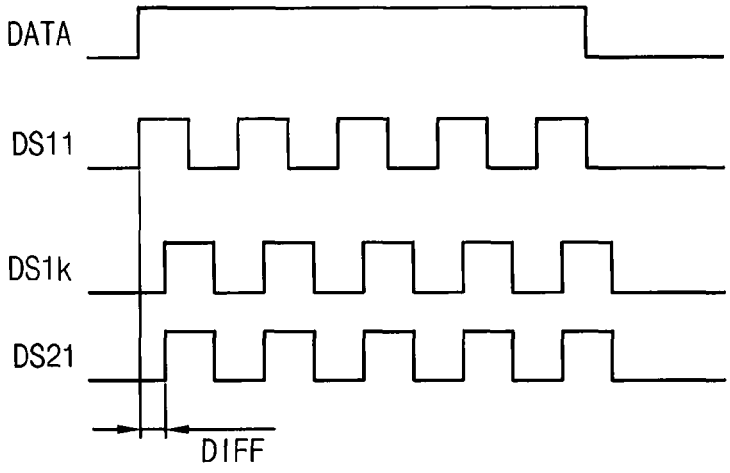
FIG. 4 is a waveforms diagram illustrating image data, a first data signal output from a first data driving circuit part, a k-th data signal output from the first data driving circuit part, and a first data signal output from a second data driving circuit part.

FIG. 4 is a waveforms diagram illustrating the image data DATA, the first data signal DS11 output from the first data driving circuit part 141, the k-th data signal DS1*k* output from the first data driving circuit part 141, and the first data signal DS21 output from the second data driving circuit part 142.

Referring to FIGS. 1 through 4, the first data driving circuit part 141 receives the image data DATA, and outputs the first to k-th data signals DS11, . . . , and DS1*k* through the plurality of channels thereof. In this case, the first data driving circuit part 141 outputs the first to k-th data signals DS11, . . . , and DS1*k* according to the delay signal DLY. The delay signal DLY includes the information on the time difference DIFF between the output time of the first reference data signal RDS11 output through the first channel of the first data driving circuit part 141 and the output time of the k-th reference data signal RDS1*k* output through the k-th channel of the first data driving circuit part 141. Therefore, The first data driving circuit part 141 delays the output of the k-th data signal DS1*k* compared to the output of the first data signal DS11 according to the time difference DIFF based on the delay signal DLY.

In addition, the second data driving circuit part 142 outputs the first data signal DS21 according to the delay signal DLY. Specifically, the second data driving circuit part 142 delays, the output of the first data signal DS21 output through the first channel of the second data driving circuit part 142 compared to the output of the first data signal DS11 output through the first channel of the first data driving circuit part 141 disposed closer to the gate driving part 130 than the second data driving circuit part 141, according to the time difference DIFF or more. Therefore, the output time of the first data signal DS21 output through the first channel of the second data driving circuit part 142 may be designated.

Figure 5:
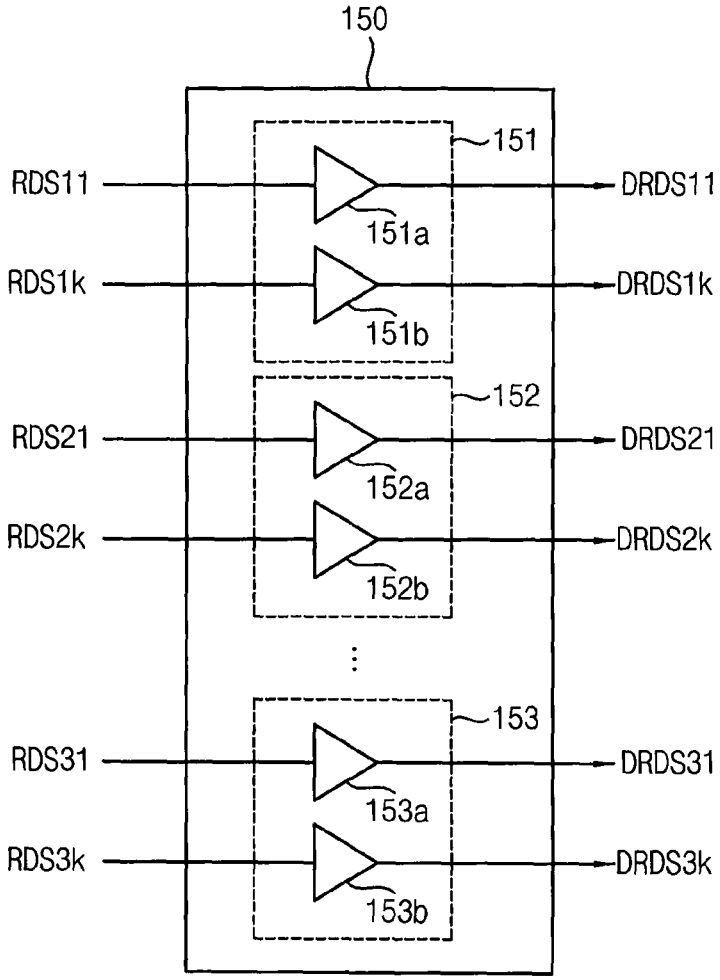
FIG. 5 is a block diagram illustrating a voltage level decreasing part of FIG. 1.

FIG. 5 is a block diagram illustrating the voltage level decreasing part 150 of FIG. 1.

Referring to FIGS. 1 through 5, the voltage level decreasing part 150 may include a first voltage level decreasing part 151, a second voltage level decreasing part 152 and a third voltage level decreasing part 153.

The first voltage level decreasing part 151 may include a first level shifter 151*a* and a second level shifter 151*b*. The first level shifter 151*a* receives the first reference data signal RDS11 output through the first channel of the first data driving circuit part 141, decreases a voltage level of the first reference data signal RDS11, and outputs a first decreased reference data signal DRDS11. The second level shifter 151*b* receives the k-th reference data signal RDS1*k* output through the k-th channel of the first data driving circuit part 141, decreases a voltage level of the k-th reference data signal RDS1*k*, and outputs a k-th decreased reference data signal DRDS1*k*.

Equally, the second voltage level decreasing part 152 may include a third level shifter 152*a* and a fourth level shifter 152*b*. The third level shifter 152*a* receives the first reference data signal RDS21 output through the first channel of the second data driving circuit part 142, decreases a voltage level of the first reference data signal RDS21, and outputs a first decreased reference data signal DRDS21. The fourth level shifter 152*b* receives the k-th reference data signal RDS2*k* output through the k-th channel of the second data driving circuit part 142, decreases a voltage level of the k-th reference data signal RDS2*k*, and outputs a k-th decreased reference data signal DRDS2*k*.

Equally, the third voltage level decreasing part 153 may include a fifth level shifter 153*a* and a sixth level shifter 153*b*. The fifth level shifter 153*a* receives the first reference data signal RDS31 output through the first channel of the third data driving circuit part 143, decreases a voltage level of the first reference data signal RDS31, and outputs a first decreased reference data signal DRDS31. The sixth level shifter 153*b* receives the k-th reference data signal RDS3*k* output through the k-th channel of the third data driving circuit part 143, decreases a voltage level of the k-th reference data signal RDS3*k*, and outputs a k-th decreased reference data signal DRDS3*k*.

The first decreased reference data signal DRDS11 output from the first level shifter 151*a*, the first decreased reference data signal DRDS21 output from the third level shifter 152*a*, and the first decreased reference data signal DRDS31 output from the fifth level shifter 153*a* illustrated in FIG. 5 may be included in the first decreased reference data signal DRDS1 illustrated in FIG. 1. In addition, the k-th decreased reference data signal DRDS1*k* output from the second level shifter 151*b*, the k-th decreased reference data signal DRDS2*k* output from the fourth level shifter 152*b*, and the k-th decreased reference data signal DRDS3*k* output from the sixth level shifter 153*b* illustrated in FIG. 5 may be included in the k-th decreased reference data signal DRDSk illustrated in FIG. 1.

Figure 6A:
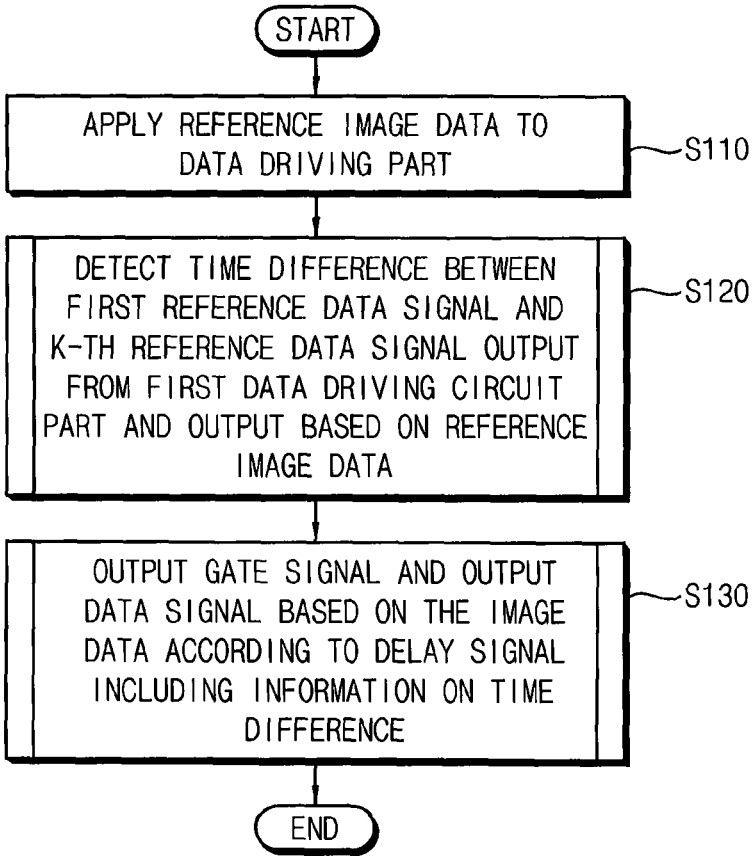
FIGS. 6A to 6C are flow charts illustrating a driving method of the display panel performed by the driving unit of display panel of FIG. 1.
Figure 6B:
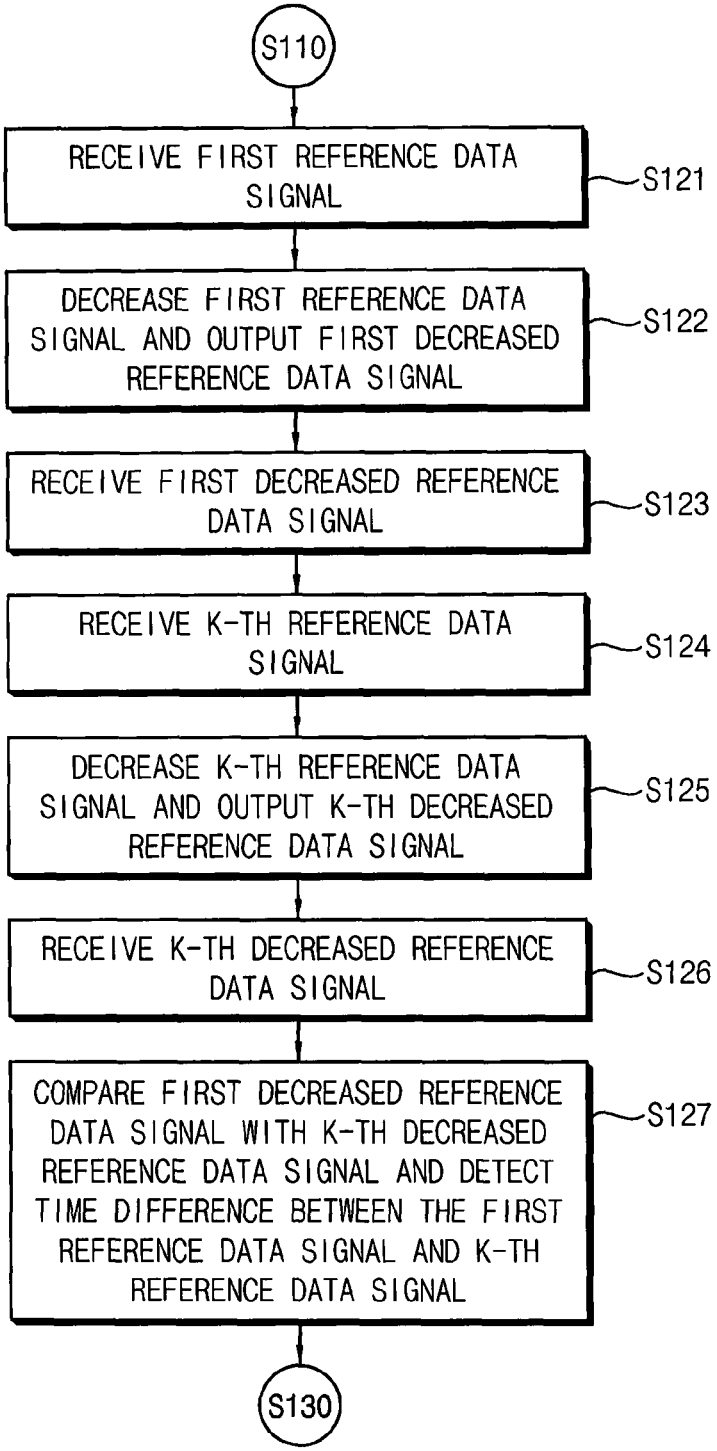
Figure 6C:
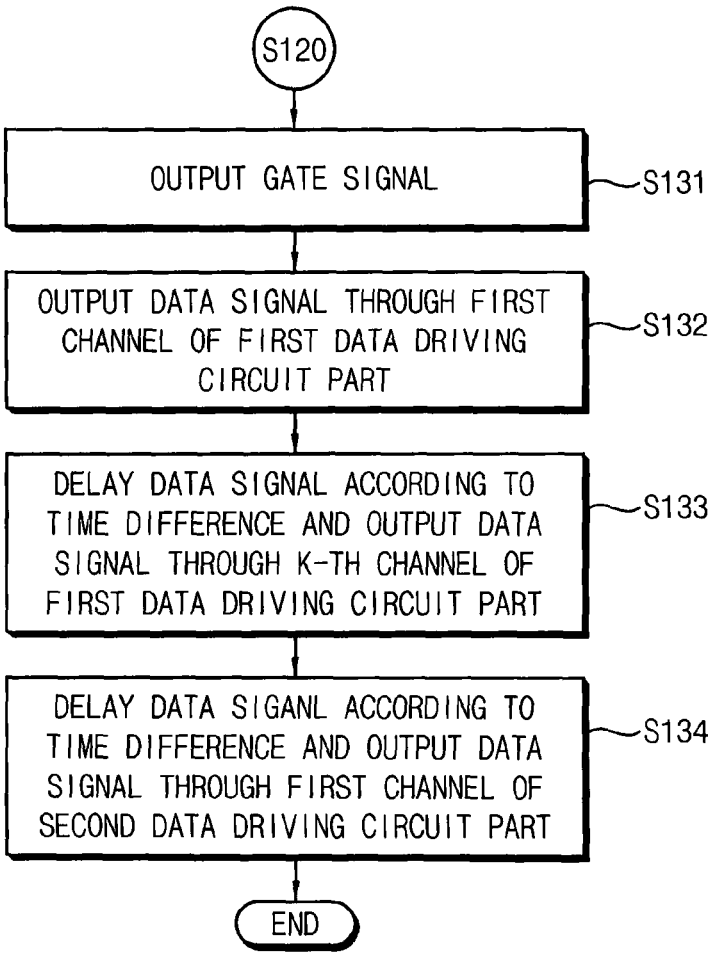

FIGS. 6A through 6C are flow charts illustrating a driving method of display panel performed by the driving unit of display panel shown in FIG. 1.

Referring to FIGS. 1 through 6C, the reference image data RDATA is applied to the data driving part 140 (step S110).

Specifically, the timing controlling part 160 outputs the reference image data RDATA to the data driving part 140 during the vertical blank period. In addition, the timing controlling part 160 outputs the gate masking signal GMS preventing the output of the gate signal GS or deactivating the gate signals GS to the gate driving part 130 during the vertical blank period.

The time difference DIFF between the first reference data signal RDS11 and the k-th reference data signal RDS1*k* output based on the reference image data RDATA is detected (step S120). Specifically, the voltage level decreasing part 150 receives the first reference data signal RDS1 from the first data driving circuit part 141 (step S121). The voltage level decreasing part 150 decreases the voltage level of the first reference data signal RDS1 and outputs the first decreased reference data signal DRDS1 which is proper to be applied to the timing controlling part 160 (step S122). The timing controlling part 160 receives the first decreased reference data signal DRDS1 from the voltage level decreasing part 150 (step S123). When the first reference data signal RDS1 output from the first data driving circuit part 141 is proper to be applied to the timing controlling part 160, the first reference data signal RDS1 may be directly applied to the timing controlling part 160. The voltage level decreasing part 150 receives the k-th reference data signal RDSk from the first data driving circuit part 141 (step S124). The voltage level decreasing part 150 decreases the voltage level of the k-th reference data signal RDSk and outputs the k-th decreased reference data signal DRDSk which is proper to be applied to the timing controlling part 160 (step S125). The timing controlling part 160 receives the k-th decreased reference data signal DRDSk from the voltage level decreasing part 150 (step S126). When the k-th reference data signal RDSk output from the first data driving circuit part 141 is proper to be applied to the timing controlling part 160, the k-th reference data signal RDSk may be directly applied to the timing controlling part 160. The timing controlling part 160 compares the first decreased reference data signal DRDS1 with the k-th decreased reference data signal DRDSk and detects the time difference DIFF between the first reference data signal RDS1 and the k-th reference data signal RDSk (step S127). When the first reference data signal RDS1 and the k-th reference data signal RDSk are directly applied to the timing controlling part 160, the timing controlling part 160 may compare the first reference data signal RDS1 with the k-th reference data signal RDSk and detect the time difference between the first reference data signal RDS1 and the k-th reference data signal RDSk.

The gate signal GS is output and the data signal DS based on the image data DATA is output according to the delay signal DLY including the information on the time difference DIFF (step S130). Specifically, the gate driving part 130 outputs the gate signals GS to the gate lines GL (step S131). The first data driving circuit part 141 outputs the first data signal DS11 through the first channel (step S132). The first data driving circuit part 141 delays the output of the k-th data signal DS1*k* compared to the output of the first data signal DS11 according to the time difference DIFF, and outputs the k-th data signal DS1*k* through the k-th channel (step S133). The second data driving circuit part 142 delays, the output of the first data signal DS21 output through the first channel of the second data driving circuit part 142 compared to the output of the first data signal DS11 output through the first channel of the first data driving circuit part 141 according to the time difference DIFF or more, and outputs the first data signal DS21 through the first channel of the second data driving circuit part 142 (step S134). In addition, the second data driving circuit part 142 may output the k-th data signal DS2*k* after delaying the output of the k-th data signal DS2*k* according to the time difference between the output time of the first reference data signal RDS21 output through the first channel of the second data driving circuit part 142 and the output time of the k-th reference data signal RDS2*k* output through the k-th channel of the second data driving circuit part 142.

In the same manner, the third data driving circuit part 143 may receive the image data DATA and output the first to k-th data signals DS31, . . . , and DS3*k* through the plurality of channels of the third data driving circuit part 143.

According to the present exemplary embodiment, the timing controlling part 160 detects the time difference between the first reference data signal RDS1 and the k-th reference data signal RDSk output from the data driving circuit parts 141, 142 and 143 depending on the load of the gate line GL and the RC delay of the gate line GL, which increases in the first direction D1. In addition, the timing controlling part 160 applies the delay signal DLY including the information on the time difference to the data driving part 140, and thus the timing controlling part 160 may set output times of the data driving circuit parts 141, 142 and 143. Therefore, a data charge rate may improve by preventing the data charge rate decrease owing to the load of the gate line GL and the RC delay of the gate line GL. This may improve display quality of the display device 100.

Figure 7:
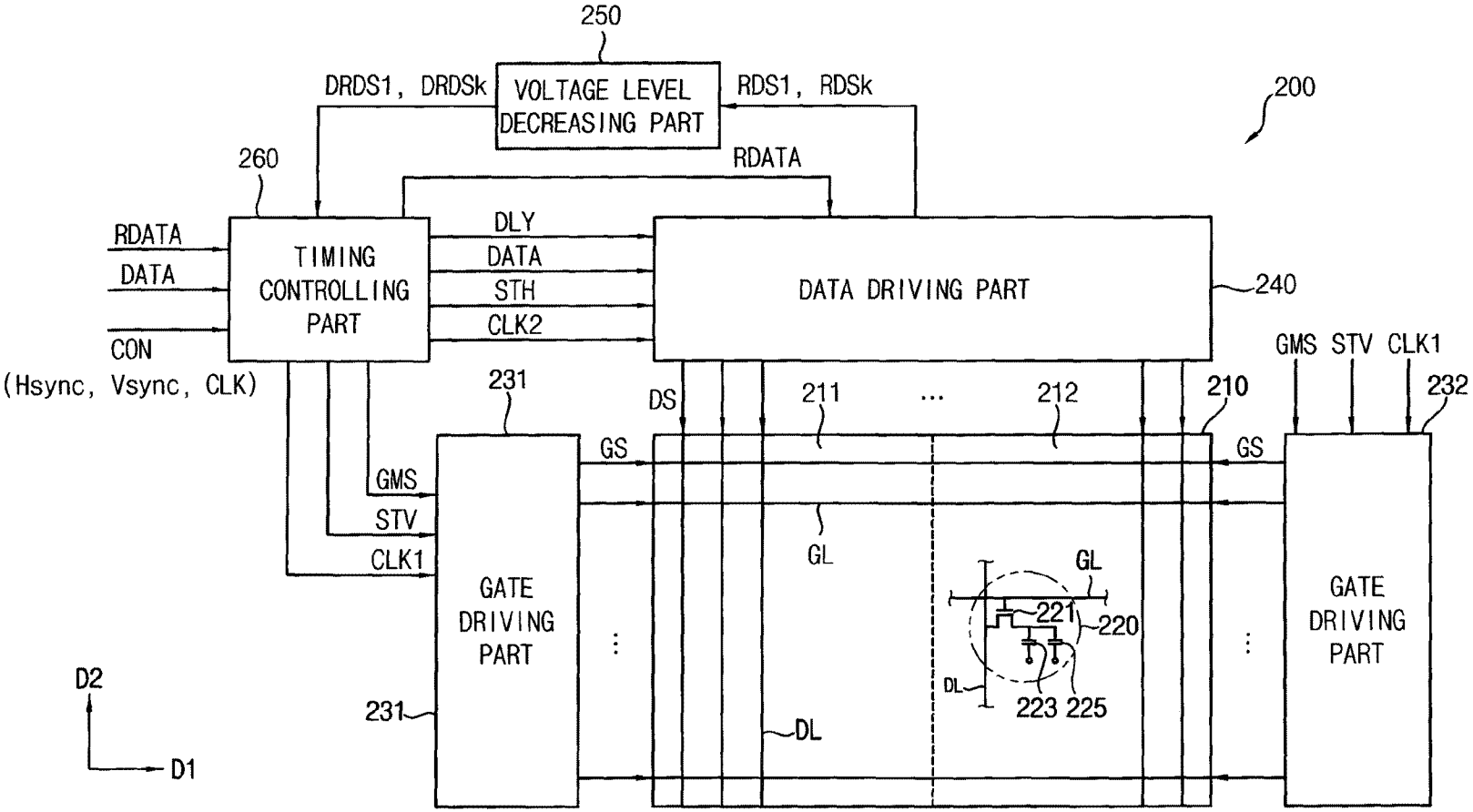
FIG. 7 is a block diagram illustrating a display device according to another exemplary embodiment of the present inventive concept.

FIG. 7 is a block diagram illustrating another display device according to an exemplary embodiment of the present inventive concept.

Referring to FIG. 7, the display device 200 according to the present exemplary embodiment includes a display panel 210, a first gate driving part 231, a second gate driving part 232, a data driving part 240, a voltage level decreasing part 250 and a timing controlling part 260. That is, the exemplary embodiment of the FIG. 7 is different from the embodiment of FIG. 1 because the gate driving part is divided into two parts 231, 232 to overcome the line delay of gate line.

The display panel 210 receives data signals DS based on image data DATA provided from the timing controlling part 260 to display an image. For example, the image data DATA may be two-dimensional plane image data. Alternatively, the image data DATA may include left-eye image data and right-eye image data for displaying a three-dimensional stereoscopic image.

The display panel 210 includes a plurality of gate lines GL, a plurality of data lines DL and a plurality of pixels 220. The gate lines GL extend in a first direction D1 and are arranged in a second direction D2 substantially perpendicular to the first direction D1. The data lines DL extend in the second direction D2 and are arranged in the first direction D1. Each of the pixels 220 includes a thin film transistor 221 electrically connected to each of the gate lines GL and the data lines DL corresponding thereto, a liquid crystal capacitor 223 and a storage capacitor 225 connected to the thin film transistor 221. In addition, the display panel 210 includes a first area 211 and a second area 212 divided in the first direction D1.

The first gate driving part 231, the second gate driving part 232, the data driving part 240, the voltage level decreasing part 250 and the timing controlling part 260 may be defined as a driving unit of display panel driving the display panel 210.

The first gate driving part 231 is disposed adjacently to first end of the gate lines GL. The first gate driving part 231 generates gate signals GS in response to a gate start signal STV and a gate clock signal CLK1 provided from the timing controlling part 260, and outputs the gate signal GS to each of the first end of the gate lines GL disposed at the first area 211. The second gate driving part 232 is disposed adjacent to a second end of the gate lines GL. The second gate driving part 232 generates the gate signals GS in response to the gate start signal STV and the gate clock signal CLK1 provided from the timing controlling part 260, and outputs the gate signal GS to each of the second end of the gate lines GL disposed at the second area 212.

In addition, each of the first gate driving part 231 and the second gate driving part 232 may not output the gate signal GS or deactivates the gate signal GS according to a gate masking signal provided from the timing controlling part 260. A period when the gate signal GS is not output or the gate signal GS is deactivated may be a vertical blank period.

The data driving part 240 outputs data signals DS to the data lines DL in response to a data start signal STH and a data clock signal CLK2 provided from the timing controlling part 260. Here, the data driving part 240 outputs the data signal DS to each of the data lines DL according to a delay signal DLY provided from the timing controlling part 260.

In addition, the data driving part 240 receives reference image data RDATA provided from the timing controlling part 260, and outputs a first reference data signal RDS1 and a k-th reference data signal RDSk based on the reference image data RDATA. Here, the first reference data signal RDS1 may be a signal output through a first channel of at least one data driving circuit part in the data driving part 240. The k-th reference data signal RDSk may be a signal output through a k-th channel of at least one data driving circuit part in the data driving part 240. The k-th channel of the data driving circuit part may be a last channel of the data driving circuit part.

The voltage level decreasing part 250 is substantially the same as the voltage level decreasing part 150 illustrated in FIG. 1 according to a previous exemplary embodiment. Thus, the voltage level decreasing part 250 receives the first reference data signal RDS1 output from the data driving part 240, decreases a voltage level of the first reference data signal RDS1, and outputs a first decreased reference data signal DRDS1 to the timing controlling part 260. The first decreased reference data signal DRDS1 may have a voltage level proper to be applied to the timing controlling part 260. In addition, the voltage level decreasing part 250 receives the k-th reference data signal RDSk output from the data driving part 240, decreases a voltage level of the k-th reference data signal RDSk, and outputs a k-th decreased reference data signal DRDSk to the timing controlling part 260. The k-th decreased reference data signal DRDSk may have a voltage level proper to be applied to the timing controlling part 260.

Alternatively, when the first reference data signal RDS1 output from the data driving part 240 has a voltage level proper to be applied to the timing controlling part 260 and the k-th reference data signal RDSk output from the data driving part 240 has a voltage level proper to be applied to the timing controlling part 260, the voltage level decreasing part 250 may be omitted. In this case, the first reference data signal RDS1 output from the data driving part 240 and the k-th reference data signal RDSk output from the data driving part 240 may be directly applied to the timing controlling part 260.

The timing controlling part 260 receives the image data DATA and a control signal CON from an outside. The control signal CON may include a horizontal synchronous signal Hsync, a vertical synchronous signal Vsync and a clock signal CLK. The timing controlling part 260 generates the data start signal STH using the horizontal synchronous signal Hsync and outputs the data start signal STH to the data driving part 240. In addition, the timing controlling part 260 generates the gate start signal STV using the vertical synchronous signal Vsync and outputs the gate start signal STV to the first gate driving part 231 and the second gate driving part 232. In addition, the timing controlling part 260 generates the gate clock signal CLK1 and the data clock signal CLK2 using the clock signal CLK, outputs the gate clock signal CLK1 to the first gate driving part 231 and the second gate driving part 232, and outputs the data clock signal CLK2 to the data driving part 240. In addition, the timing controlling part 260 outputs the gate masking signal GMS which prevents an output of the gate signal GS or deactivates the gate signal GS during the vertical blank period to the first gate driving part 231 and the second gate driving part 232.

In addition, the timing controlling part 260 receives the reference image data RDATA from an outside and outputs the reference image data RDATA to the data driving part 240 during the vertical blank period. For example, the reference image data RDATA may be the data displaying stripe patterns, a polarity of the reference image data RDATA may be inverted in every pixel 220 in the first direction D1 and the second direction D2, may be inverted in every two pixels 220 in the first direction D1 and the second direction D2, and may be inverted in every four pixels 220 in the first direction D1 and the second direction D2.

In addition, the timing controlling part 260 receives the first decreased reference data signal DRDS1 and the k-th decreased reference data signal DRDSk from the voltage level decreasing part 250, calculates a time difference between an output of the first decreased reference data signal DRDS1 and an output of the k-th decreased reference data signal DRDSk, and detects a time difference between an output of the first reference data signal RDS1 and an output of the k-th reference data signal RDSk. The timing controlling part 260 outputs the delay signal DLY including information on the time difference between the output time of the first reference data signal RDS1 and the output time of the k-th reference data signal RDSk to the data driving part 240. The timing controlling part 260 may detect the time difference and output the delay signal DLY during the vertical blank period. The delay signal DLY may be applied to the data driving part 240 through an interface protocol, and the delay signal DLY may be allocated to a portion for setting frame construction and configuration in the interface protocol.

Figure 8:
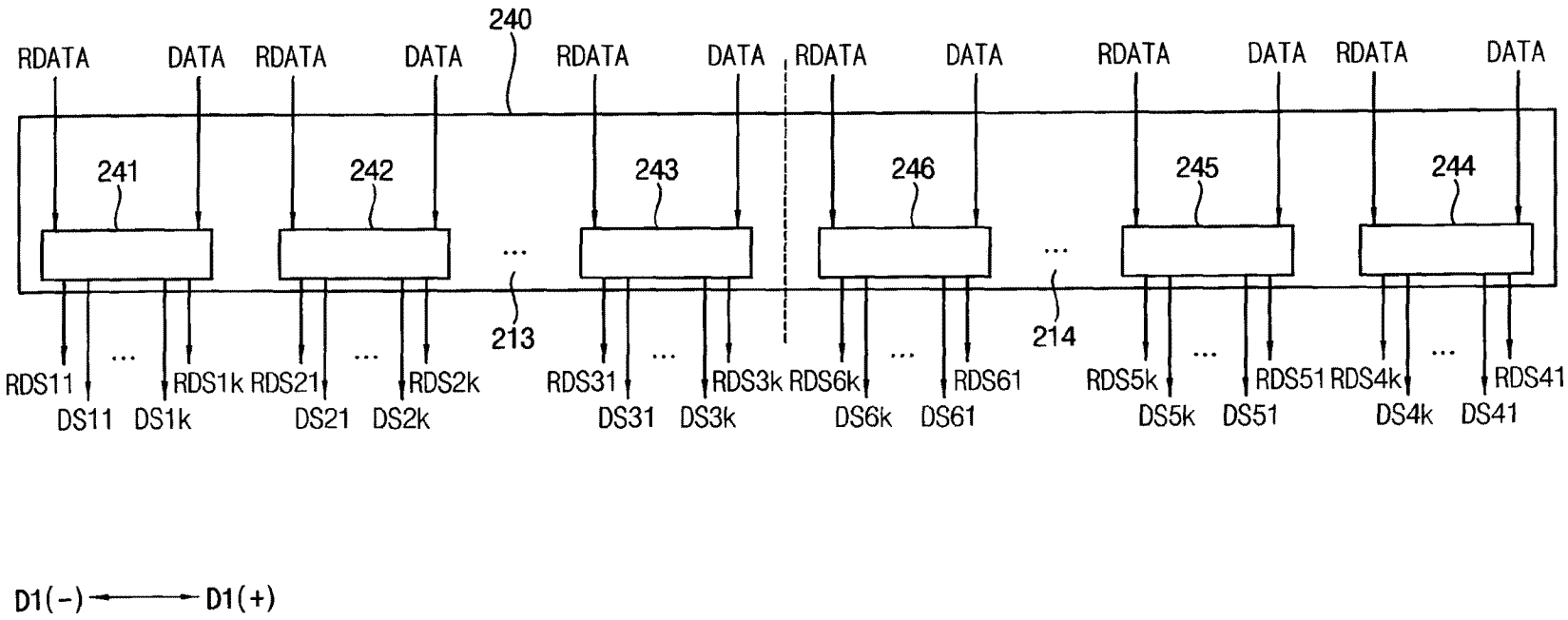
FIG. 8 is a block diagram illustrating a data driving part of FIG. 7.

FIG. 8 is a block diagram illustrating the data driving part 240 of FIG. 7.

Referring to FIGS. 7 and 8, the data driving part 240 may include a plurality of data driving circuit parts 241, 242, . . . , and 246.

A first data driving circuit part 241, a second data driving circuit part 242 and a third data driving circuit part 243 may be sequentially disposed from a negative positive direction D1(−) to a first positive direction D1(+) in a third area 213 corresponding to the first area 211 of the display panel 210. Thus, the first data driving circuit part 241 may be disposed at a first position in the first positive direction D1(+) in the third area 213, the second data driving circuit part 242 may be disposed next to the first data driving circuit part 241 in the first positive direction D1(+) in the third area 213, and the third data driving circuit part 243 may be disposed at a last position in the first positive direction D1(+) in the third area 213.

The first data driving circuit part 241 receives the reference image data RDATA, outputs a first reference data signal RDS11 through a first channel of the first data driving circuit part 241 and outputs a k-th reference data signal RDS1*k* through a k-th channel of the first data driving circuit part 241.

A time difference is generated between the first reference data signal RDS11 output through the first channel of the first data driving circuit part 241 and the k-th reference data signal RDS1*k* output through the k-th channel of the first data driving circuit part 241. Specifically, a load of the gate line GL and an RC delay of the gate line GL increases in the first positive direction D1(+). Therefore, the k-th reference data signal RDS1*k* is delayed and activated according to the time difference compared to the first reference data signal RDS11.

The second data driving circuit part 242 receives the reference image data RDATA, outputs a first reference data signal RDS21 through a first channel of the second data driving circuit part 242 and outputs a k-th reference data signal RDS2*k* through a k-th channel of the second data driving circuit part 242.

As the load of the gate line GL and the RC delay of the gate line GL increase in the first positive direction D1(+), a time difference between the first reference data signal RDS21 and the k-th reference data signal RDS2*k* may be longer than that of the time difference between the first reference data signal RDS11 and the k-th reference data signal RDS1*k*. Thus, in the third area 213, the farther a data driving circuit part is from the first gate driving part 231 in the first positive direction D1(+), the longer a time difference between an output time of a first reference data signal output through a first channel of the data driving circuit part and an output time of a k-th reference data signal output through a k-th channel of the data driving circuit part may be.

The third data driving circuit part 243 receives the reference image data RDATA, outputs a first reference data signal RDS31 through a first channel of the third data driving circuit part 243, and outputs a k-th reference data signal RDS3*k* through a k-th channel of the third data driving circuit part 243.

In addition, the first data driving circuit part 241 receives the image data DATA, and outputs the first to k-th data signals DS11, . . . , and DS1*k* through the plurality of channels thereof. In this case, the first data driving circuit part 241 outputs the first to k-th data signals DS11, . . . , and DS1*k* according to the delay signal DLY. The delay signal DLY includes the information on the time difference between the output time of the first reference data signal RDS11 output through the first channel of the first data driving circuit part 241 and the output time of the k-th reference data signal RDS1*k* output through the k-th channel of the first data driving circuit part 241. The first data driving circuit part 241 delays the output of the k-th data signal DS1*k* compared to the output of the first data signal DS11 according to the time difference based on the delay signal DLY. Thus, the delay signal DLY may set an output time of the k-th data signal DS1*k* output from the first data driving circuit part 241.

In addition, the second data driving circuit part 242 receives the image data DATA, and outputs the first to k-th data signals DS21, . . . , and DS2*k* through the plurality of channels thereof. In this case, the second first data driving circuit part 242 outputs the first to k-th data signals DS21, . . . , and DS2*k* according to the delay signal DLY. The delay signal DLY includes the information on the time difference between the output time of the first reference data signal RDS21 output through the first channel of the second data driving circuit part 242 and the output time of the k-th reference data signal RDS2*k* output through the k-th channel of the second data driving circuit part 242. The second data driving circuit part 242 delays the output of the k-th data signal DS2*k* compared to the output of the first data signal DS21 according to the time difference based on the delay signal DLY. Thus, the delay signal DLY may set an output time of the k-th data signal DS2*k* output from the second data driving circuit part 242.

In addition, the second data driving circuit part 242 outputs the first data signal DS21 according to the delay signal DLY. Specifically, the second data driving circuit part 242 delays, the output of the first data signal DS21 output through the first channel of the second data driving circuit part 242 compared to the output of the first data signal DS11 output through the first channel of the first data driving circuit part 241 disposed previously to the second data driving circuit part 241, according to the time difference or more, which is between the output time of the first reference data signal RDS11 output from the first data driving circuit part 241 and the output time of the k-th reference data signal RDS1*k* output from the first data driving circuit part 241. Therefore, the output time of the first data signal DS21 output through the first channel of the second data driving circuit part 242 may be designated. Thus, the delay signal DLY may set an output time of the first data signal DS21 output from the second data driving circuit part 242.

In the same manner, the third data driving circuit part 243 receives the image data DATA, and outputs first to third data signals DS31, . . . , and DS3*k* through the plurality of channels thereof.

A fourth data driving circuit part 244, a fifth data driving circuit part 245 and a sixth data driving circuit part 246 may be sequentially disposed from the first positive direction D1(+) to the first negative direction D1(−) in a fourth area 214 corresponding to the second area 212 of the display panel 210. Thus, the fourth data driving circuit part 244 may be disposed at a first position in the first negative direction D1(−) in the fourth area 214, the fifth data driving circuit part 245 may be disposed next to the fourth data driving circuit part 244 in the first negative direction D1(−) in the fourth area 214, and the sixth data driving circuit part 246 may be disposed at a last position in the first negative direction D1(−) in the fourth area 214.

The fourth data driving circuit part 244 receives the reference image data RDATA, outputs a first reference data signal RDS41 through a first channel of the fourth data driving circuit part 244 and outputs a k-th reference data signal RDS4*k* through a k-th channel of the fourth data driving circuit part 244.

A time difference is generated between the first reference data signal RDS41 output through the first channel of the fourth data driving circuit part 244 and the k-th reference data signal RDS4*k* output through the k-th channel of the fourth data driving circuit part 244. Specifically, the load of the gate line GL and the RC delay of the gate line GL increases in the first negative direction D1(+). Therefore, the k-th reference data signal RDS4*k* is delayed and activated according to the time difference compared to the first reference data signal RDS41.

The fifth data driving circuit part 245 receives the reference image data RDATA, outputs a first reference data signal RDS51 through a first channel of the fifth data driving circuit part 245 and outputs a k-th reference data signal RDS5*k* through a k-th channel of the fifth data driving circuit part 245.

As the load of the gate line GL and the RC delay of the gate line GL increase in the first negative direction D1(−), a time difference between the first reference data signal RDS51 and the k-th reference data signal RDS5*k* may be longer than that of the time difference between the first reference data signal RDS41 and the k-th reference data signal RDS4*k*. Thus, in the fourth area 214, the farther a data driving circuit part is from the second gate driving part 232 in the first negative D1(−), the longer a time difference between an output time of a first reference data signal output through a first channel of the data driving circuit part and an output time of a k-th reference data signal output through a k-th channel of the data driving circuit part may be.

The sixth data driving circuit part 246 receives the reference image data RDATA, outputs a first reference data signal RDS61 through a first channel of the sixth data driving circuit part 246, and outputs a k-th reference data signal RDS6*k* through a k-th channel of the sixth data driving circuit part 246.

In addition, the fourth data driving circuit part 244 receives the image data DATA, and outputs the first to k-th data signals DS41, . . . , and DS4*k* through the plurality of channels thereof. In this case, the fourth data driving circuit part 244 outputs the first to k-th data signals DS41, . . . , and DS4*k* according to the delay signal DLY. The delay signal DLY includes the information on the time difference between the output time of the first reference data signal RDS41 output through the first channel of the fourth data driving circuit part 244 and the output time of the k-th reference data signal RDS4*k* output through the k-th channel of the fourth data driving circuit part 244. The fourth data driving circuit part 244 delays the output of the k-th data signal DS4*k* compared to the output of the first data signal DS41 according to the time difference based on the delay signal DLY. Thus, the delay signal DLY may set an output time of the k-th data signal DS4*k* output from the fourth data driving circuit part 244.

In addition, the fifth data driving circuit part 245 receives the image data DATA, and outputs the first to k-th data signals DS51, . . . , and DS5*k* through the plurality of channels thereof. In this case, the fifth data driving circuit part 245 outputs the first to k-th data signals DS51, . . . , and DS5*k* according to the delay signal DLY. The delay signal DLY includes the information on the time difference between the output time of the first reference data signal RDS51 output through the first channel of the fifth data driving circuit part 245 and the output time of the k-th reference data signal RDS5*k* output through the k-th channel of the fifth data driving circuit part 245. The fifth data driving circuit part 245 delays the output of the k-th data signal DS5*k* in comparison with the output of the first data signal DS51 according to the time difference based on the delay signal DLY. Thus, the delay signal DLY may set an output time of the k-th data signal DS4*k* output from the fourth data driving circuit part 244.

In addition, the fifth data driving circuit part 245 outputs the first data signal DS51 according to the delay signal DLY. Specifically, the fifth data driving circuit part 245 delays, the output of the first data signal DS51 output through the first channel of the fifth data driving circuit part 245 compared to the output of the first data signal DS41 output through the first channel of the fourth data driving circuit part 244 disposed previously to the fifth data driving circuit part 245 in the first negative direction D1(−), according to the time difference or more, which is between the output time of the first reference data signal RDS41 output from the fourth data driving circuit part 244 and the output time of the k-th reference data signal RDS4*k* output from the fourth data driving circuit part 244. Therefore, the output time of the first data signal DS51 output through the first channel of the fifth data driving circuit part 245 may be designated. Thus, the delay signal DLY may set the output time of the first data signal DS51 output from the fifth data driving circuit part 245.

In the same manner, the sixth data driving circuit part 246 receives the image data DATA, and outputs first to third data signals DS61, . . . , and DS6*k* through the plurality of channels thereof.

The first reference data signal RDS11, the first reference data signal RDS21, the first reference data signal RDS31, the first reference data signal RDS41, the first reference data signal RDS51, and the first reference data signal RDS61 illustrated in FIG. 8 may be included in the first reference data signal RDS1 illustrated in FIG. 7. In addition, the k-th reference data signal RDS1*k*, the k-th reference data signal RDS2*k*, the k-th reference data signal RDS3*k*, the k-th reference data signal RDS4*k*, the k-th reference data signal RDS5*k*, and the k-th reference data signal RDS6*k* illustrated in FIG. 8 may be included in the k-th reference data signal RDSk illustrated in FIG. 7.

In addition, the first to k-th data signals DS11, . . . , and DS1*k*, the first to k-th data signals DS21, . . . , and DS2*k*, the first to k-th data signals DS31, . . . , and DS3*k*, the first to k-th data signals DS41, . . . , and DS4*k*, the first to k-th data signals DS51, . . . , and DS5*k*, and the first to k-th data signals DS61, . . . , and DS6*k* illustrated in FIG. 8 may be included in the data signals DS illustrated in FIG. 7.

A method of driving a display panel performed by the display panel driving apparatus of FIG. 7 is the substantially the same as the method of driving a display panel described with reference to FIGS. 6A to 6C according to a previous exemplary embodiment except for applying the gate signal GS to the both ends of the gate line GL. Thus, a detailed description of the method of driving a display panel performed by the display panel driving apparatus of FIG. 7 will be omitted.

According to the present exemplary embodiment, the timing controlling part 260 detects the time difference between the first reference data signal RDS1 and the k-th reference data signal RDSk output from the data driving circuit parts 241, 242, . . . , and 246 according to the load of the gate line GL and the RC delay of the gate line GL which are increased in the first positive direction D1(+) and the first negative direction D1(−). In addition, the timing controlling part 260 applies the delay signal DLY including the information on the time difference to the data driving part 240, and thus the timing controlling part 260 may set output times of the data driving circuit parts 241, 242, . . . , and 246. Therefore, a data charge rate may improve by preventing a data charge rate decrease owing to the load of the gate line GL and the RC delay of the gate line GL. This may improve display quality of the apparatus 200.

According to the driving method of a display panel, the driving unit of display panel for performing the method and the display device having the driving unit of display panel, a data charge rate may be increased by preventing a decrease of a data charge rate owing to a load of a gate line and an RC delay of the gate line GL. Thus, display quality of a display device may be improved.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

What is claimed is:

1. A driving method of a display panel, the method comprising:

applying reference image data to a data driving part driving a display panel including a plurality of gate lines and a plurality of data lines;

detecting a time difference between a first reference data signal and a k-th reference data signal;

outputting a gate signal to each of the gate lines; and outputting a data signal based on image data to each of the data lines according to a delay signal including information on the time difference.

2. The method of claim 1, wherein the first reference data signal is output based on the reference image data and output through a first channel of a first data driving circuit part in the data driving part, and the k-th reference data signal is output based on the reference image data and output through a k-th channel of the first data driving circuit part.

3. The method of claim 1, wherein step of detecting the time difference between the first reference data signal and the k-th reference data signal comprises:

receiving the first reference data signal;

receiving the k-th reference data signal; and comparing the first reference data signal with the k-th reference data signal to detect the time difference between the first reference data signal and the k-th reference data signal.

4. The method of claim 3, further comprising:

decreasing a voltage level of the first reference data signal to output a first decreased reference data signal;

decreasing a voltage level of the k-th reference data signal to output a k-th decreased reference data signal;

comparing the first decreased reference data signal with the k-th decreased reference data signal to detect the time difference between the first reference data signal and the k-th reference data signal.

5. The method of claim 1, wherein step of outputting the data signal comprises:

outputting a first data signal through a first channel of the first data driving circuit part;

outputting a k-th data signal through a k-th channel of the first data driving circuit part by delaying the data signal according to the time difference.

6. The method of claim 5, further comprising:

outputting a first data signal through a first channel of a second data driving circuit part next to the first data driving circuit part by delaying the data signal according to or more than the time difference.

7. The method of claim 5, wherein step of outputting the k-th data signal through the k-th channel of the first data driving circuit part comprises:

applying the delay signal to the data driving part and setting an output time of the k-th data signal.

8. The method of claim 6, wherein step of outputting the first data signal through the first channel of the second data driving circuit part comprises:

applying the delay time to the data driving part and setting an output time of the first data signal from the second data driving circuit part.

9. The method of claim 1, further comprising:

outputting a gate masking signal while the reference image data is applied to the data driving part and while detecting the time difference between the first reference data signal and the k-th reference data signal.

10. The method of claim 1, wherein the reference image data are applied to the data driving part during a vertical blank period.

11. The method of claim 10, wherein detecting the time difference between the first reference data signal and the k-th reference data signal is performed during the vertical blank period.

12. The method of claim 1, wherein the k-th channel of the first data driving circuit part is a last channel of the first data driving circuit part.

13. A driving unit of display panel, comprising:

a data driver configured to receive reference image data and including a first data driving circuit part having a first channel outputting a first reference data signal based on the reference image data and a k-th channel outputting a k-th reference data signal based on the reference image data;

a timing controller configured to detect a time difference between the first reference data signal and the k-th reference data signal; and a gate driver configured to output a gate signal to each of gate lines.

14. The driving unit of display panel of claim 13, wherein the data driver outputs the data signal to each of the data lines according to a delay signal including information on the time difference.

15. The driving unit of display panel of claim 13, wherein the timing controller outputs a gate masking signal while the reference image data is applied to the data driver and while detecting the time difference between the first reference data signal and the k-th reference data signal.

16. The driving unit of display panel of claim 13, wherein the reference image data are applied to the data driver during a vertical blank period.

17. The driving unit of display panel of claim 13, further comprising:

a voltage level decreasing part which decreases a voltage level of the first reference data signal and decrease a voltage level of the k-th reference data signal, wherein the voltage level decreasing part comprises:

a first level shifter configured to receive the first reference data signal from the data driver, decrease the first reference data signal, and output a first decreased reference data signal to the timing controller; and a second level shifter configured to receive the k-th reference data signal from the data driver, decrease the k-th reference data signal, and output a k-th decreased reference data signal to the timing controller.

18. A display device, comprising:

a display panel including a plurality of gate lines and a plurality of data lines; and a driving unit of the display panel;

wherein the driving unit comprises;

a data driver configured to receive reference image data and include a first data driving circuit part having a first channel outputting a first reference data signal based on the reference image data and a k-th channel outputting a k-th reference data signal based on the reference image data;

a timing controller configured to detect a time difference between the first reference data signal and the k-th reference data signal; and a gate driver configured to output a gate signal to each of the gate lines.

19. The display device of claim 18, wherein the k-th channel of the first data driving circuit part is a last channel of the first data driving circuit part.

20. The display device of claim 18, wherein the gate driver comprises:

a first gate driver configured to output the gate signals to a first end of the gate lines; and a second gate driver configured to output the gate signals to a second end of the gate lines.

* * * * *